US011655429B2

(12) United States Patent
van Houten et al.

(10) Patent No.: US 11,655,429 B2
(45) Date of Patent: May 23, 2023

(54) LUBRICATING OIL COMPOSITION

(71) Applicants: Chevron Oronite Company LLC, San Ramon, CA (US); Chevron Oronite Technology B.V., San Ramon, CA (US)

(72) Inventors: Wilhelmus Petrus Antonie van Houten, Prinsenbeek (NL); Ronald Theodorus Fake Jukes, Rotterdam (NL); Todd Brookhart, Walnut Creek, CA (US)

(73) Assignee: CHEVRON ORONITE COMPANY LLC, San Ramon, CA (US)

( * ) Notice: Subject to any disclaimer, the term of this patent is extended or adjusted under 35 U.S.C. 154(b) by 0 days.

(21) Appl. No.: 16/446,756

(22) Filed: Jun. 20, 2019

(65) Prior Publication Data

US 2020/0002637 A1 Jan. 2, 2020

Related U.S. Application Data

(60) Provisional application No. 62/690,374, filed on Jun. 27, 2018.

(51) Int. Cl.

| | |
|---|---|
| ***C10M 129/94*** | (2006.01) |
| ***C10M 101/02*** | (2006.01) |
| ***C10M 169/04*** | (2006.01) |
| *C10N 30/04* | (2006.01) |
| *C10N 30/00* | (2006.01) |
| *C10N 40/25* | (2006.01) |

(52) U.S. Cl.

CPC ..... *C10M 129/94* (2013.01); *C10M 101/02* (2013.01); *C10M 169/04* (2013.01); *C10M 2207/144* (2013.01); *C10N 2030/04* (2013.01); *C10N 2030/52* (2020.05); *C10N 2040/252* (2020.05); *C10N 2040/255* (2020.05)

(58) Field of Classification Search

CPC ..... C10M 129/94; C10M 129/48; C10M 2207/144; C10M 101/02; C10M 169/04; C10N 2030/04; C10N 2030/52

USPC ..... 508/518

See application file for complete search history.

(56) References Cited

U.S. PATENT DOCUMENTS

| | | | | |
|---|---|---|---|---|
| 5,330,666 | A | 7/1994 | Habeeb | |
| 5,688,751 | A | 11/1997 | Cleveland | |
| 9,206,374 | B2 | 12/2015 | Jukes | |
| 10,457,887 | B2 | 10/2019 | Van Houten | |
| 2007/0027043 | A1 | 2/2007 | Le Coent | |
| 2009/0029889 | A1 | 1/2009 | Poirier et al. | |
| 2009/0281009 | A1* | 11/2009 | Van Houten | C10M 159/20 508/287 |
| 2011/0077182 | A1* | 3/2011 | Jukes | C10M 129/54 508/460 |
| 2011/0319304 | A1* | 12/2011 | Van Houten | C10M 111/02 508/459 |
| 2012/0028522 | A1* | 2/2012 | Garner | C10M 169/045 440/88 L |
| 2012/0034829 | A1* | 2/2012 | Bertram | C10M 169/045 440/88 L |
| 2013/0157912 | A1* | 6/2013 | Jukes | C10M 163/00 508/294 |
| 2014/0182537 | A1* | 7/2014 | Dodd | C10M 129/54 123/1 A |
| 2014/0287969 | A1* | 9/2014 | Jukes | C10M 169/044 508/332 |
| 2016/0137949 | A1* | 5/2016 | Houten | F02B 43/02 123/1 A |
| 2016/0237371 | A1* | 8/2016 | Houten | C10M 135/08 |
| 2016/0281014 | A1* | 9/2016 | Muir | C10L 10/06 |
| 2016/0340604 | A1* | 11/2016 | van Houten | C10M 169/045 |
| 2019/0002783 | A1* | 1/2019 | Gill | C10M 159/22 |
| 2019/0002788 | A1* | 1/2019 | Gill | C10M 159/22 |
| 2019/0002791 | A1* | 1/2019 | Boffa | C10M 141/08 |
| 2019/0002795 | A1* | 1/2019 | Gill | C10M 119/02 |
| 2019/0256794 | A1* | 8/2019 | Boons | C10M 129/10 |
| 2020/0369975 | A1* | 11/2020 | Delbridge | C10M 143/18 |
| 2021/0002578 | A1* | 1/2021 | Tanaka | C10M 159/22 |

FOREIGN PATENT DOCUMENTS

| | | | |
|---|---|---|---|
| EP | 2403930 | A1 | 1/2012 |
| WO | 2016124291 | A1 | 8/2016 |
| WO | 2018069460 | A1 | 4/2018 |

OTHER PUBLICATIONS

PCT International Search Report and Written Opinion, dated Nov. 26, 2019, issued in International Application No. PCT/IB2019/055204, filed on Jun. 20, 2019, 11 pages.

Singapore Office Action dated Jan. 7, 2022, issued in Application No. 11202012267W, filed on Dec. 9, 2020, 6 pages.

China Office Action dated Feb. 9, 2022 issued in Application No. 201980043066.X, filed on Dec. 25, 2020, 8 pages.

* cited by examiner

*Primary Examiner* — Ellen M McAvoy

(57) ABSTRACT

A lubricating oil composition is provided which comprises (a) greater than 50 wt. % of a base oil of lubricating viscosity; and (b) 0.1 to 20 wt. % of an alkyl-substituted hydroxyaromatic carboxylic acid, wherein the alkyl substituent of the alkyl-substituted hydroxyaromatic carboxylic acid has from 12 to 40 carbon atoms; wherein the lubricating oil composition is a monograde lubricating oil composition meeting specifications for SAE J300 revised January 2015 requirements for a SAE 20, 30, 40, 50, or 60 monograde engine oil, and has a TBN of 5 to 200 mg KOH/g, as determined by ASTM D2896.

14 Claims, No Drawings

LUBRICATING OIL COMPOSITION

TECHNICAL FIELD

This disclosure relates to lubricating oil compositions containing an ashless alkyl-substituted hydroxyaromatic carboxylic acid.

BACKGROUND

Lubricants are routinely formulated with metal detergent additives. However, excess of overbased detergent present, for example in marine diesel lubricants, creates a significant excess of basic sites and a risk of destabilization of the micelles of unused overbased detergent, which contain insoluble metallic salts. This destabilization results in the formation of deposits of insoluble metallic salts in ash formation which plates out onto cylinder walls and other engine components.

It is therefore desirable to include lubricating additives which provide improved performance benefits which do not contribute to additional levels of overbased metal detergent.

The present disclosure is directed to achieving improvements in performance of lubricants by employing an ashless alkyl-substituted hydroxyaromatic carboxylic acid.

SUMMARY

In one aspect, there is provided a lubricating oil composition comprising (a) greater than 50 wt. % of a base oil of lubricating viscosity; and (b) 0.1 to 20 wt. % of an alkyl-substituted hydroxyaromatic carboxylic acid, wherein the alkyl substituent of the alkyl-substituted hydroxyaromatic carboxylic acid has from 12 to 40 carbon atoms; wherein the lubricating oil composition is a monograde lubricating oil composition meeting specifications for SAE J300 revised January 2015 requirements for a SAE 20, 30, 40, 50, or 60 monograde engine oil, and has a TBN of 5 to 200 mg KOH/g, as determined by ASTM D2896.

In another aspect, there is provided a method of lubricating an internal combustion engine comprising supplying to the internal combustion engine the lubricating oil composition disclosed herein.

DETAILED DESCRIPTION

Introduction

In this specification, the following words and expressions, if and when used, have the meanings ascribed below.

A "major amount" means greater than 50 wt. % of a composition.

A "minor amount" means less than 50 wt. % of a composition.

An "alpha-olefin" as used in this specification and claims refers to an olefin that has a carbon-carbon double bond between the first and second carbon atoms of the longest contiguous chain of carbon atoms. The term "alpha-olefin" includes linear and branched alpha olefins unless expressly stated otherwise. In the case of branched alpha olefins, a branch can be at the 2-position (a vinylidene) and/or the 3-position or higher with respect to the olefin double bond. The term "vinylidene" whenever used in this specification and claims refers to an alpha olefin having a branch at the 2-position with respect to the olefin double bond. Alpha-olefins are almost always mixtures of isomers and often also mixtures of compounds with a range of carbon numbers.

Low molecular weight alpha olefins, such as the $C_6$, $C_8$, $C_{10}$, $C_{12}$ and $C_{14}$ alpha olefins, are almost exclusively 1-olefins. Higher molecular weight olefin cuts such as $C_{16}$-$C_{18}$ or $C_{20}$-$C_{24}$ have increasing proportions of the double bond isomerized to an internal or vinylidene position A "normal alpha olefin" refers to a linear aliphatic mono-olefin having a carbon-carbon double bond between the first and second carbon atoms. It is noted that "normal alpha olefin" is not synonymous with "linear alpha olefin" as the term "linear alpha olefin" can include linear olefinic compounds having a double bond between the first and second carbon atoms.

"Isomerized olefins" or "isomerized normal alpha-olefins" refers to olefins obtained by isomerizing olefins. Generally isomerized olefins have double bonds in different positions than the starting olefins from which they are derived, and may also have different characteristics.

"TBN" means total base number as measured by ASTM D2896.

"$KV_{100}$" means kinematic viscosity at 100° C. as measured by ASTM D445.

"Weight percent" (wt. %), unless expressly stated otherwise, means the percentage that the recited component(s), compounds(s) or substituent(s) represents of the total weight of the entire composition.

All percentages reported are weight % on an active ingredient basis (i.e., without regard to carrier or diluent oil) unless otherwise stated. The diluent oil for the lubricating oil additives can be any suitable base oil (e.g., a Group I base oil, a Group II base oil, a Group III base oil, a Group IV base oil, a Group V base oil, or a mixture thereof).

Lubricating Oil Composition

The lubricating oil composition of the present disclosure comprises (a) greater than 50 wt. % of a base oil of lubricating viscosity; and (b) 0.1 to 20 wt. % of an alkyl-substituted hydroxyaromatic carboxylic acid, wherein the alkyl substituent of the alkyl-substituted hydroxyaromatic carboxylic acid has from 12 to 40 carbon atoms; wherein the lubricating oil composition is a monograde lubricating oil composition meeting specifications for SAE J300 revised January 2015 requirements for a SAE 20, 30, 40, 50, or 60 monograde engine oil, and has a TBN of 5 to 200 mg KOH/g, as determined by ASTM D2896.

The lubricating oil composition is a monograde lubricating oil composition meeting specifications for SAE J300 revised January 2015 requirements for a SAE 20, 30, 40, 50, or 60 monograde engine oil. A SAE 20 oil has a kinematic viscosity at 100° C. of 6.9 to <9.3 $mm^2/s$. A SAE 30 oil has a kinematic viscosity at 100° C. of 9.3 to <12.5 $mm^2/s$. A SAE 40 oil has a kinematic viscosity at 100° C. of 12.5 to <16.3 $mm^2/s$. A SAE 50 oil has a kinematic viscosity at 100° C. of 16.3 to <21.9 $mm^2/s$. A SAE 60 oil has a kinematic viscosity at 100° C. of 21.9 to <26.1 $mm^2/s$.

In some embodiments, the lubricating oil composition is suitable for use as a marine cylinder lubricant (MCL). Marine cylinder lubricants are typically made to the SAE 30, SAE 40, SAE 50 or SAE 60 monograde specification in order to provide a sufficiently thick lubricant film at the high temperatures on the cylinder liner wall. Typically, marine diesel cylinder lubricants have a TBN ranging from 15 to 200 mg KOH/g (e.g., from 15 to 150 mg KOH/g, from 15 to 60 mg KOH/g, from 20 to 200 mg KOH/g, from 20 to 150 mg KOH/g from 20 to 120 mg KOH/g, from 20 to 80 mg KOH/g, from 30 to 200 mg KOH/g, from 30 to 150 mg KOH/g, from 30 to 120 mg KOH/g, from 30 to 100 mg KOH/g, from 30 to 80 mg KOH/g, from 60 to 200 mg KOH/g, from 60 to 150 mg KOH/g, from 60 to 120 mg KOH/g, from 60 to 100 mg KOH/g, from 60 to 80 mg KOH/g, from 80 to 200 mg KOH/g, from 80 to 150 mg KOH/g, from 80 to 150 mg 120 KOH/g, from 120 to 200 mg KOH/g, or from 120 to 150 mg KOH/g).

In some embodiments, the present lubricating oil composition is suitable for use as a marine system oil. Marine system oil lubricants are typically made to the SAE 20, SAE 30 or SAE 40 monograde specification. The viscosity for the marine system oil is set at such a relatively low level in part because a system oil can increase in viscosity during use and the engine designers have set viscosity increase limits to prevent operational problems. Typically, marine system oil lubricants have a TBN ranging from 5 to 12 mg KOH/g (e.g., from 5 to 10 mg KOH/g, or from 5 to 9 mg KOH/g).

In some embodiments, the present lubricating oil composition is suitable for use as a marine trunk piston engine oil (TPEO). Marine TPEO lubricants are typically made to the SAE 30 or SAE 40 monograde specification. Typically, marine TPEO lubricants have a TBN ranging from 10 to 60 mg KOH/g (e.g., from 10 to 30 mg KOH/g, from 20 to 60 mg KOH/g, from 20 to 40 mg KOH/g, from 30 to 60 mg KOH/g, or from 30 to 55 mg KOH/g).

Oil of Lubricating Viscosity

The oil of lubricating viscosity may be selected from any of the base oils in Groups I-V as specified in the American Petroleum Institute (API) Base Oil Interchangeability Guidelines (API 1509). The five base oil groups are summarized in Table 1:

TABLE 1

| Group | Saturates(1) | Sulfur(2) | Viscosity Index(3) | |
|---|---|---|---|---|
| I | <90% and/or | >0.03% and | ≥80 to <120 | |
| II | ≥90% and | ≤0.03% and | ≥80 to <120 | |
| III | ≥90% and | ≤0.03% and | ≥120 | |
| IV | | | | Polyalphaolefins (PAO) |
| V | | | | All other base stocks not included in Groups I, II, III or IV |

(1)ASTM D2007
(2)ASTM D2270
(3)ASTM D3120, ASTM D4294, or ASTM D4297

Groups I, II, and III are mineral oil process stocks. Group IV base oils contain true synthetic molecular species, which are produced by polymerization of olefinically unsaturated hydrocarbons. Many Group V base oils are also true synthetic products and may include diesters, polyol esters, polyalkylene glycols, alkylated aromatics, polyphosphate esters, polyvinyl ethers, and/or polyphenyl ethers, and the like, but may also be naturally occurring oils, such as vegetable oils. It should be noted that although Group III base oils are derived from mineral oil, the rigorous processing that these fluids undergo causes their physical properties to be very similar to some true synthetics, such as PAOs. Therefore, oils derived from Group III base oils may be referred to as synthetic fluids in the industry.

The base oil used in the disclosed lubricating oil composition may be a mineral oil, animal oil, vegetable oil, synthetic oil, or mixtures thereof. Suitable oils may be derived from hydrocracking, hydrogenation, hydrofinishing, unrefined, refined, and re-refined oils, and mixtures thereof.

Unrefined oils are those derived from a natural, mineral, or synthetic source without or with little further purification treatment. Refined oils are similar to the unrefined oils except that they have been treated in one or more purification steps, which may result in the improvement of one or more properties. Examples of suitable purification techniques are solvent extraction, secondary distillation, acid or base extraction, filtration, percolation, and the like. Oils refined to the quality of an edible may or may not be useful. Edible oils may also be called white oils. In some embodiments, lubricating oil compositions are free of edible or white oils.

Re-refined oils are also known as reclaimed or reprocessed oils. These oils are obtained similarly to refined oils using the same or similar processes. Often these oils are additionally processed by techniques directed to removal of spent additives and oil breakdown products.

Mineral oils may include oils obtained by drilling or from plants and animals or any mixtures thereof. Such oils may include castor oil, lard oil, olive oil, peanut oil, corn oil, soybean oil, and linseed oil, as well as mineral lubricating oils, such as liquid petroleum oils and solvent-treated or acid-treated mineral lubricating oils of the paraffinic, naphthenic or mixed paraffinic-naphthenic types. Such oils may be partially or fully hydrogenated, if desired. Oils derived from coal or shale may also be useful.

Useful synthetic lubricating oils may include hydrocarbon oils such as polymerized, oligomerized, or interpolymerized olefins (e.g., polybutylenes, polypropylenes, propylene/isobutylene copolymers); poly(1-hexenes), poly(1-octenes), trimers or oligomers of 1-decene, e.g., poly(1-decenes), such materials being often referred to as α-olefins, and mixtures thereof; alkylbenzenes (e.g. dodecylbenzenes, tetradecylbenzenes, dinonylbenzenes, di-(2-ethyl hexyl)-benzenes); polyphenyls (e.g., biphenyls, terphenyls, alkylated polyphenyls); diphenyl alkanes, alkylated diphenyl alkanes, alkylated diphenyl ethers and alkylated diphenyl sulfides and the derivatives, analogs and homologs thereof or mixtures thereof. Polyalphaolefins are typically hydrogenated materials.

Other synthetic lubricating oils include polyol esters, diesters, liquid esters of phosphorus-containing acids (e.g., tricresyl phosphate, trioctyl phosphate, and the diethyl ester of decane phosphonic acid), or polymeric tetrahydrofurans. Synthetic oils may be produced by Fischer-Tropsch reactions and typically may be hydroisomerized Fischer-Tropsch hydrocarbons or waxes. In one embodiment oils may be prepared by a Fischer-Tropsch gas-to-liquid synthetic procedure as well as other gas-to-liquid oils.

Base oils for use in the formulated lubricating oils useful in the present disclosure are any of the variety of oils corresponding to API Group I, Group II, Group III, Group IV, and Group V oils and mixtures thereof. In one embodiment, the base oil is a Group II base oil or a blend of two or more different base oils (e.g. mixtures of Group I and Group II base oils). In another embodiment, the base oil is a Group I base oil or a blend of two or more different Group I base oils. Suitable Group I base oils include any light overhead cuts from a vacuum distillation column, such as, for example, any Light Neutral, Medium Neutral, and Heavy Neutral base stocks. The base oil may also include residual base stocks or bottoms fractions such as bright stock. Bright stock is a high viscosity base oil which has been conventionally produced from residual stocks or bottoms and has been highly refined and dewaxed. Bright stock can have a kinematic viscosity at 40° C. of greater than 180 $mm^2/s$ (e.g., greater than 250 $mm^2/s$, or even in a range of 500 to 1100 $mm^2/s$).

The base oil constitutes the major component of the lubricating oil composition of the present disclosure and is present in an amount greater than 50 wt. % (e.g., at least 60 wt. %, at least 70 wt. %, at least 80 wt. %, or at least 90 wt. %), based on the total weight of the composition. The base oil conveniently has a kinematic viscosity of 2 to 40 $mm^2/s$, as measured at 100° C.

Ashless Alkyl-Substituted Hydroxyaromatic Carboxylic Acid

The alkyl-substituted hydroxyaromatic carboxylic acid of the present disclosure will be present in the lubricating oil composition in a minor amount compared to the oil of lubricating viscosity. The concentration of the alkyl-substituted hydroxyaromatic carboxylic acid in the lubricating oils of this disclosure can range from 0.1 to 20 wt. % or more (e.g., 0.25 to 15 wt. %, 0.5 to 10 wt. %, 0.75 to 5 wt. %, or 1 to 5 wt. %, or 2 to 5 wt. %), based on the total weight of the lubricating oil.

One embodiment of the present disclosure is directed to an alkyl-substituted hydroxyaromatic carboxylic acid represented by the following structure (1):

(1)

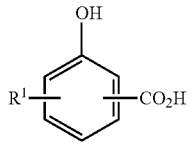

wherein the carboxylic acid group may be in the ortho, meta, or para position, or mixtures thereof, relative to the hydroxyl group; and $R^1$ is an alkyl substituent having from 12 to 40 carbon atoms (e.g., 14 to 28 carbon atoms, 14 to 18 carbon atoms, 18 to 30 carbon atoms, 20 to 28 carbon atoms, or 20 to 24 carbon atoms).

The alkyl substituent of the alkyl-substituted hydroxyaromatic carboxylic acid can be a residue derived from an alpha-olefin having from 12 to 40 carbon atoms. In one embodiment, the alkyl substituent is a residue derived from an alpha-olefin having from 14 to 28 carbon atoms. In one embodiment, the alkyl substituent is a residue derived from an alpha-olefin having from 14 to 18 carbon atoms. In one embodiment, the alkyl substituent is a residue derived from an alpha-olefin having from 20 to 28 carbon atoms. In one embodiment, the alkyl substituent is a residue derived from an alpha-olefin having from 20 to 24 carbon atoms. In one embodiment, the alkyl substituent of the alkyl-substituted hydroxyaromatic carboxylic acid is a residue derived from an olefin comprising $C_{12}$ to $C_{40}$ oligomers of a monomer selected from propylene, butylene, or mixtures thereof. Examples of such olefins include propylene tetramer, butylene trimer, isobutylene oligomers (e.g., polyisobutylene), tetramer dimer and the like. The olefins employed may be linear, isomerized linear, branched or partially branched linear. The olefin may be a mixture of linear olefins, a mixture of isomerized linear olefins, a mixture of branched olefins, a mixture of partially branched linear or a mixture of any of the foregoing. The alpha-olefin may be a normal alpha-olefin, an isomerized normal alpha-olefin, or a mixture thereof.

In one embodiment where the alkyl substituent is a residue derived from an isomerized alpha-olefin, the alpha-olefin can have an isomerization level (I) of 0.1 to 0.4 (e.g., 0.1 to 0.3, or 0.1 to 0.2). The isomerization level (I) can be determined by $^1H$ NMR spectroscopy and represents the relative amount of methyl groups (—$CH_3$) (chemical shift 0.30-1.01 ppm) attached to the methylene backbone groups (—$CH_2$—) (chemical shift 1.01-1.38 ppm) and is defined by the following formula:

$$I=m/(m+n)$$

where m is the $^1H$ NMR integral for methyl groups with chemical shifts between 0.30±0.03 to 1.01±0.03 ppm, and n is the $^1H$ NMR integral for methylene groups with chemical shifts between 1.01±0.03 to 1.38±0.10 ppm.

In one embodiment, the alkyl-substituted hydroxyaromatic carboxylic acid may be represented by the following structure (2):

(2)

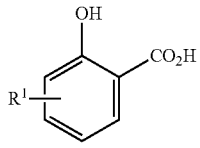

wherein $R^1$ is as described herein above.

In one embodiment, the alkyl-substituted hydroxyaromatic carboxylic acid is derived from an alkyl-substituted hydroxyaromatic compound which is an alkylation product of a hydroxyaromatic compound (e.g., phenol) and a β-branched primary alcohol (e.g., a $C_{12}$-$C_{40}$ Guerbet-type alcohol) such as described in U.S. Pat. No. 8,704,006.

In one embodiment, the alkyl-substituted hydroxyaromatic carboxylic acid is derived from a renewable source of alkyl phenolic compounds such as distilled cashew nut shell liquid (CNSL) or hydrogenated distilled CNSL. Distilled CNSL is a mixture of meta-hydrocarbyl substituted phenols, where the hydrocarbyl group is linear and unsaturated, including cardanol. Catalytic hydrogenation of distilled CNSL gives rise to a mixture meta-hydrocarbyl substituted phenols predominantly rich in 3-pentadecylphenol.

Alkyl-substituted hydroxyaromatic carboxylic acids may be prepared by methods known in the art, such as described, for example, in U.S. Pat. Nos. 8,030,258 and 8,993,499.

Process for Preparing the Alkyl-Substituted Hydroxyaromatic Carboxylic Acid

The alkyl-substituted hydroxyaromatic carboxylic acid of this disclosure can be prepared by any process known to one skilled in the art for making alkyl-substituted hydroxyaromatic carboxylic acids. For example, a process for preparing an alkyl-substituted hydroxyaromatic carboxylic acid can comprise (a) alkylating a hydroxyaromatic compound with an olefin to produce an alkyl-substituted hydroxyaromatic compound; (b) reacting the alkyl-substituted hydroxyaromatic compound with an alkali metal base to produce an alkali metal salt of an alkyl-substituted hydroxyaromatic compound; (c) carboxylating the alkali metal salt of an alkyl-substituted hydroxyaromatic compound with a carboxylating agent (e.g., $CO_2$) to produce an alkali metal alkyl-substituted hydroxyaromatic carboxylate; and (d) acidifying the alkali metal alkyl-substituted hydroxyaromatic carboxylate with an aqueous solution of an acid strong enough to produce an alkyl-substituted hydroxyaromatic carboxylic acid.

(A) Alkylation

The alkylation can be carried out by charging a hydrocarbon feed comprising a hydroxyaromatic compound or a mixture of hydroxyaromatic compounds, an olefin or a mixture of olefins, and an acid catalyst to a reaction zone in which agitation is maintained. The resulting mixture is held in the alkylation zone under alkylation conditions for a time sufficient to allow substantial conversion (e.g., at least 70% mole % of the olefin has reacted) of the olefin to the hydroxyaromatic alkylate. After the desired reaction time, the reaction mixture is removed from the alkylation zone and fed to a liquid-liquid separator to allow hydrocarbon products to separate from the acid catalyst which may be recycled to the reactor in a closed loop. The hydrocarbon product may be further treated to remove excess unreacted hydroxyaromatic compounds and olefinic compounds from the desired alkylate product. The excess hydroxyaromatic compounds can also be recycled to the reactor.

Suitable hydroxyaromatic compounds include monocyclic hydroxyaromatic compounds and polycyclic hydroxyaromatics containing one or more aromatic moieties, such as one or more benzene rings, optionally fused together or otherwise connected via alkylene bridges. Exemplary hydroxyaromatic compounds include phenol, cresol, and naphthol. In one embodiment, the hydroxyaromatic compound is phenol. In one embodiment, the hydroxyaromatic compound is naphthol.

The olefins employed may be linear, isomerized linear, branched or partially branched linear. The olefin may be a mixture of linear olefins, a mixture of isomerized linear olefins, a mixture of branched olefins, a mixture of partially branched linear or a mixture of any of the foregoing. In some embodiments, the olefin is a normal alpha-olefin, an isomerized normal alpha-olefin, or a mixture thereof.

In some embodiments, the olefin is a mixture of normal alpha-olefins selected from olefins having from 12 to 40 carbon atoms per molecule (e.g., 14 to 28 carbon atoms per molecule, 14 to 18 carbon atoms per molecule, 18 to 30 carbon atoms per molecule, 20 to 28 carbon atoms per molecule, 20 to 24 carbon atoms per molecule) In some embodiments, the normal alpha-olefins are isomerized using at least one of a solid or liquid catalyst.

In another embodiment, the olefins include one or more olefins comprising $C_{12}$ to $C_{40}$ oligomers of monomers selected from propylene, butylene or mixtures thereof. Generally, the one or more olefins will contain a major mount of the $C_{12}$ to $C_{40}$ oligomers of monomers selected from propylene, butylene or mixtures thereof. Examples of such olefins include propylene tetramer, butylene trimer and the like. As one skilled in the art will readily appreciate, other olefins may be present. For example, the other olefins that can be used in addition to the $C_{12}$ to $C_{40}$ oligomers include linear olefins, cyclic olefins, branched olefins other than propylene oligomers such as butylene or isobutylene oligomers, arylalkylenes and the like and mixtures thereof. Suitable linear olefins include 1-hexene, 1-nonene, 1-decene, 1-dodecene and the like and mixtures thereof. Especially suitable linear olefins are high molecular weight normal alpha-olefins such as $C_{16}$ to $C_{30}$ normal alpha-olefins, which can be obtained from processes such as ethylene oligomerization or wax cracking. Suitable cyclic olefins include cyclohexene, cyclopentene, cyclooctene and the like and mixtures thereof. Suitable branched olefins include butylene dimer or trimer or higher molecular weight isobutylene oligomers, and the like and mixtures thereof. Suitable arylalkylenes include styrene, methyl styrene, 3-phenylpropene, 2-phenyl-2-butene and the like and mixtures thereof.

Any suitable reactor configuration may be used for the reactor zone. These include batch and continuously stirred tank reactors, reactor riser configurations, and ebullating or fixed bed reactors.

The alkylation can be carried out at a temperature of from 15° C. to 200° C. and at a sufficient pressure that a substantial portion of the feed components remain in the liquid phase. Typically, a pressure of 0 to 150 psig is satisfactory to maintain feed and products in the liquid phase.

The residence time in the reactor is a time that is sufficient to convert a substantial portion of the olefin to alkylate product. The time required may be from 30 seconds to about 300 minutes. A more precise residence time may be determined by those skilled in the art using batch stirred reactors to measure the kinetics of the alkylation process.

The at least one hydroxyaromatic compound or mixture of hydroxyaromatic compounds and the mixture of olefins may be injected separately into the reaction zone or may be mixed prior to injection. Both single and multiple reaction zones may be used with the injection of the hydroxyaromatic compounds and the olefins into one, several, or all reaction zones. The reaction zones need not be maintained at the same process conditions.

The hydrocarbon feed for the alkylation process may comprise a mixture of hydroxyaromatic compounds and a mixture of olefins in which the molar ratio of hydroxyaromatic compounds to olefins is from 0.5:1 to 50:1 or more. In the case where the molar ratio of hydroxyaromatic compounds to olefins is greater than 1:1, there is an excess of hydroxyaromatic compounds present. Preferably, an excess of hydroxyaromatic compounds is used to increase reaction rate and improve product selectivity. When excess hydroxyaromatic compounds are used, the excess unreacted hydroxyaromatic compounds in the reactor effluent can be separated (e.g., by distillation) and recycled to the reactor.

Typically, the alkyl-substituted hydroxyaromatic compound comprises a mixture of mono alkyl-substituted isomers. The alkyl group of the alkyl-substituted hydroxyaromatic compound is typically attached to the hydroxyaromatic compound primarily in the ortho and para positions, relative to the hydroxyl group. In one embodiment, the alkylation product may contain 1 to 99% ortho isomer and 99 to 1% para isomer. In another embodiment, the alkylation product may contain 5 to 70% ortho and 95 to 30% para isomer.

The acidic alkylation catalyst is a strong acid catalyst such as a Brønsted or a Lewis acid. Useful strong acid catalysts include hydrofluoric acid, hydrochloric acid, hydrobromic acid, perchloric acid, nitric acid, sulfuric acid, trifluoromethane sulfonic acid, fluorosulfonic acid, AMBERLYST® 36 sulfonic acid (available from The Dow Chemical Company), nitric acid, aluminium trichloride, aluminium tribromide, boron trifluoride, antimony pentachloride, and the like and mixtures thereof. Acidic ionic liquids can be used as an alternative to the commonly used strong acid catalysts in alkylation processes.

(B) Neutralization

The alkyl-substituted hydroxyaromatic compound is neutralized with an alkali metal base (e.g., oxide or hydroxides of lithium, sodium or potassium). Neutralization may take place in the presence of a light solvent (e.g., toluene, xylene isomers, light alkylbenzene, and the like) to form an alkali metal salt of the alkyl-substituted hydroxyaromatic compound. In one embodiment, the solvent forms an azeotrope with water. In another embodiment, the solvent may be a mono-alcohol such as 2-ethylhexanol. In this case, the 2-ethylhexanol is eliminated by distillation before carboxylation. The objective with the introduction of a solvent is to facilitate the elimination of water.

The neutralization is carried out a temperature high enough to eliminate water. The neutralization may be conducted under a slight vacuum in order to require a lower reaction temperature.

In one embodiment, xylene is used as a solvent and the reaction conducted at a temperature of 130° C. to 155° C. under an absolute pressure about 80 kPa.

In another embodiment, 2-ethylhexanol is used as a solvent. As the boiling point of 2-ethylhexanol (184° C.) is significantly higher than xylene (140° C.), the neutralization is conducted at a temperature of at least 150° C.

The pressure may be reduced gradually below atmospheric pressure in order to complete the distillation of water. In one embodiment, the pressure is reduced to no more 7 kPa.

By providing that operations are carried out at a sufficiently high temperature and that the pressure in the reactor is reduced gradually below atmospheric, the formation of the alkali metal salt of an alkyl-substituted hydroxyaromatic compound is carried out without the need to add a solvent and forms an azeotrope with the water formed during this reaction. For instance, the temperature is ramped up to 200° C. and then the pressure is gradually reduced below atmospheric. Preferably, the pressure is reduced to no more than 7 kPa.

Elimination of water may occur over a period of at least 1 hour (e.g., at least 3 hours).

The quantities of reagent may correspond to the following: a molar ratio of alkali metal base to alkyl-substituted hydroxaromatic compound of from 0.5: to 1.2:1 (e.g., 0.9:1 to 1.05:1); and a wt./wt. ratio of solvent to alkyl-substituted hydroxyaromatic compound of from 0.1:1 to 5:1 (e.g., 0.3:1 to 3:1).

(C) Carboxylation

The carboxylation step is conducted by simply bubbling carbon dioxide ($CO_2$) into the reaction medium originating from the preceding neutralization step and is conducted until at least 50 mole % of the starting alkali metal salt of an alkyl-substituted hydroxyaromatic compound is converted to an alkali metal alkyl-substituted hydroxyaromatic carboxylate (measured as hydroxybenzoic acid by potentiometric determination).

At least 50 mole % (e.g., at least 75 mole %, or even at least 85 mole %) of the starting the alkali metal salt of an alkyl-substituted hydroxyaromatic compound is converted to an alkali metal alkyl-substituted hydroxyaromatic carboxylate using $CO_2$ at a temperature from 110° C. to 200° C. under a pressure of from 0.1 to 1.5 MPa, for a period between 1 and 8 hours.

In one variant with a potassium salt, the temperature may be from 125° C. to 165° C. (e.g., 130° C. to 155° C.) and the pressure may be from 0.1 to 1.5 MPa (e.g., 0.1 to 0.4 MPa).

In another variant with a sodium salt, the temperature is directionally lower and may be from 110° C. to 155° C. (e.g., 120° C. to 140° C.) and the pressure may be from 0.1 to 2.0 MPa (e.g., 0.3 to 1.5 MPa).

The carboxylation is usually carried out in a diluent such as hydrocarbons or alkylate (e.g., benzene, toluene, xylene, and the like). In this case, the weight ratio of solvent to the alkali metal salt of the alkyl-substituted hydroxyaromatic compound may range from 0.1:1 to 5:1 (e.g., 0.3:1 to 3:1).

In another variant, no solvent is used. In this case, carboxylation is conducted in the presence of diluent oil in order to avoid a too viscous material. The weight ratio of diluent oil to the alkali metal salt of the alkyl-substituted hydroxyaromatic compound may range from 0.1:1 to 2:1 (e.g., from 0.2:1 to 1:1, or from 0.2:1 to 0.5:1).

(D) Acidification

The alkali metal alkyl-substituted hydroxyaromatic carboxylate produced above is then contacted with at least one acid capable of converting the alkali metal alkyl-substituted hydroxyaromatic carboxylate to an alkyl-substituted hydroxyaromatic carboxylic acid. Such acids are well known in the art to acidify the aforementioned alkali metal salt. Usually hydrochloric acid or aqueous sulfuric acid is utilized.

Other Performance Additives

The formulated lubricating oil of the present disclosure may additionally contain one or more of the other commonly used lubricating oil performance additives. Such optional components may include detergents (e.g., metal detergents), dispersants, antiwear agents, antioxidants, friction modifiers, corrosion inhibitors, rust inhibitors, demulsifiers, foam inhibitors, viscosity modifiers, pour point depressants, nonionic surfactants, thickeners, and the like. Some are discussed in further detail below.

Detergents

A detergent is an additive that reduces formation of piston deposits, for example high-temperature varnish and lacquer deposits in engines; it normally has acid-neutralizing properties and is capable of keeping finely-divided solids in suspension. Most detergents are based on metal "soaps", that is metal salts of acidic organic compounds.

Detergents generally comprise a polar head with a long hydrophobic tail, the polar head comprising the metal salt of the acidic organic compound. The salts may contain a substantially stoichiometric amount of the metal when they are usually described as normal or neutral salts and would typically have a TBN at 100% active mass of from 0 to <100 mg KOH/g. Large amounts of a metal base can be included by reaction of an excess of a metal compound, such as an oxide or hydroxide, with an acidic gas such as carbon dioxide.

The resulting overbased detergent comprises neutralized detergent as an outer layer of a metal base (e.g., carbonate) micelle. Such overbased detergents may have a TBN at 100% active mass of 100 mg KOH/g or greater (e.g., 200 to 500 mg KOH/g or more).

Suitably, detergents that may be used include oil-soluble neutral and overbased sulfonates, phenates, sulfurized phenates, thiophosphonates, salicylates and naphthenates and other oil-soluble carboxylates of a metal, particularly alkali metal or alkaline earth metals (e.g., Li, Na, K, Ca and Mg). The most commonly used metals are Ca and Mg, which may both be present in detergents used in lubricating compositions, and mixtures of Ca and/or Mg with Na. Detergents may be used in various combinations.

The detergent can be present at 0.5 to 20 wt. % of the lubricating oil composition.

Dispersants

During engine operation, oil-insoluble oxidation by-products are produced. Dispersants help keep these by-products in solution, thus diminishing their deposition on metal surfaces. Dispersants are often known as ashless-type dispersants because, prior to mixing in a lubricating oil composition, they do not contain ash-forming metals and they do not normally contribute any ash when added to a lubricant. Ashless-type dispersants are characterized by a polar group attached to a relatively high molecular or weight hydrocarbon chain. Typical ashless dispersants include N-substituted long chain alkenyl succinimides. Examples of N-substituted long chain alkenyl succinimides include polyisobutylene succinimide with number average molecular weight of the polyisobutylene substituent in a range of 500 to 5000

Daltons (e.g., 900 to 2500 Daltons). Succinimide dispersants and their preparation are disclosed, for instance in U.S. Pat. Nos. 4,234,435 and 7,897,696. Succinimide dispersants are typically an imide formed from a polyamine, typically a poly(ethyleneamine).

In some embodiments the lubricant composition comprises at least one polyisobutylene succinimide dispersant derived from polyisobutylene with number average molecular weight in the range of 500 to 5000 Daltons (e.g., 900 to 2500 Daltons). The polyisobutylene succinimide may be used alone or in combination with other dispersants.

The dispersant may also be post-treated by conventional methods by reaction with any of a variety of agents. Among these agents are boron compounds (e.g., boric acid) and cyclic carbonates (ethylene carbonate).

Another class of dispersants includes Mannich bases. Mannich bases are materials that are formed by the condensation of a higher molecular weight, alkyl substituted phenol, a polyalkylene polyamine, and an aldehyde such as formaldehyde. Mannich bases are described in more detail in U.S. Pat. No. 3,634,515.

Another class of dispersant includes high molecular weight esters, prepared by reaction of a hydrocarbyl acylating agent and a polyhydric aliphatic alcohol such as glycerol, pentaerythritol, or sorbitol. Such materials are described in more detail in U.S. Pat. No. 3,381,022.

Another class of dispersants includes high molecular weight ester amides.

The dispersant can be present at 0.1 to 10 wt. % of the lubricating oil composition.

Antiwear Agents

Anti-wear agents reduce friction and excessive wear and are usually based on compounds containing sulfur or phosphorous or both. Noteworthy are dihydrocarbyl dithiophosphate metal salts wherein the metal may be an alkali or alkaline earth metal, or aluminium, lead, tin, molybdenum, manganese, nickel, copper, or zinc. Zinc dihydrocarbyl dithiophosphates (ZDDP) are oil-soluble salts of dihydrocarbyl dithiophosphoric acids and may be represented by the following formula:

$$Zn[SP(S)(OR)(OR')]_2$$

wherein R and R' may be the same or different hydrocarbyl radicals containing from 1 to 18 (e.g., 2 to 12) carbon atoms. To obtain oil solubility, the total number of carbon atoms (i.e., R and R') in the dithiophosphoric acid will generally be 5 or greater.

The antiwear agent can be present at 0.1 to 6 wt. % of the lubricating oil composition.

Antioxidants

Antioxidants retard the oxidative degradation of base oils during service. Such degradation may result in deposits on metal surfaces, the presence of sludge, or a viscosity increase in the lubricant.

Useful antioxidants include hindered phenols. Hindered phenol antioxidants often contain a secondary butyl and/or a tertiary butyl group as a sterically hindering group. The phenol group may be further substituted with a hydrocarbyl group (typically linear or branched alkyl) and/or a bridging group linking to a second aromatic group. Examples of hindered phenol antioxidants include 2,6-di-tert-butylphenol, 2,6-di-tert-butylcresol, 2,4,6-tri-tert-butylphenol, 2,6-di-alkyl-phenolic propionic ester derivatives, and bisphenols such as 4,4'-bis(2,6-di-tert-butylphenol) and 4,4'-methylene-bis(2,6-di-tert-butylphenol).

Sulfurized alkylphenols and alkali and alkaline earth metal salts thereof are also useful as antioxidants.

Non-phenolic antioxidants which may be used include aromatic amine antioxidants such as diarylamines and alkylated diarylamines. Particular examples of aromatic amine antioxidants include phenyl-α-naphthylamine, 4,4'-dioctyldiphenylamine, butylated/octylated diphenylamine, nonylated diphenylamine, and octylated phenyl-α-naphthylamine.

The antioxidant can be present at 0.01 to 5 wt. % of the lubricating oil composition.

Friction Modifiers

A friction modifier is any material that can alter the coefficient of friction of a surface lubricated by any lubricant or fluid containing such material. Suitable friction modifiers may include fatty amines, esters such as borated glycerol esters, fatty phosphites, fatty acid amides, fatty epoxides, borated fatty epoxides, alkoxylated fatty amines, borated alkoxylated fatty amines, metal salts of fatty acids, or fatty imidazolines, and condensation products of carboxylic acids and polyalkylene-polyamines. As used herein, the term "fatty" in relation to friction modifiers means a carbon chain having 10 to 22 carbon atoms, typically a straight carbon chain. Molybdenum compounds are also known as friction modifiers. The friction modifier can be present at 0.01 to 5 wt. % of the lubricating oil composition.

Rust Inhibitors

Rust inhibitors generally protect lubricated metal surfaces against chemical attack by water or other contaminants. Suitable rust inhibitors may include nonionic suitable rust inhibitors include nonionic polyoxyalkylene agents (e.g., polyoxyethylene lauryl ether, polyoxyethylene higher alcohol ether, polyoxyethylene nonylphenyl ether, polyoxyethylene octylphenyl ether, polyoxyethylene octyl stearyl ether, polyoxyethylene oleyl ether, polyoxyethylene sorbitol monostearate, polyoxyethylene sorbitol monooleate, and polyethylene glycol monooleate); stearic acid and other fatty acids; dicarboxylic acids; metal soaps; fatty acid amine salts; metal salts of heavy sulfonic acid; partial carboxylic acid esters of polyhydric alcohols; phosphoric esters; (short-chain) alkenyl succinic acids, partial esters thereof and nitrogen-containing derivatives thereof; and synthetic alkarylsulfonates (e.g., metal dinonylnaphthalene sulfonates). Such additives can be present at 0.01 to 5 wt. % of the lubricating oil composition.

Demulsifiers

Demulsifiers promote oil-water separation in lubricating oil compositions exposed to water or steam. Suitable demulsifiers include trialkyl phosphates, and various polymers and copolymers of ethylene glycol, ethylene oxide, propylene oxide, or mixtures thereof. Such additives can be present at 0.01 to 5 wt. % of the lubricating oil composition.

Foam Inhibitors

Foam inhibitors retard the formation of stable foams. Silicones and organic polymers are typical foam inhibitors. For example, polysiloxanes, such as silicon oil, or polydimethylsiloxane, provide foam inhibiting properties. Further foam inhibitors include copolymers of ethyl acrylate and 2-ethylhexyl acrylate and optionally vinyl acetate. Such additives can be present at 0.001 to 1 wt. % of the lubricating oil composition.

Viscosity Modifiers

Viscosity modifiers provide lubricants with high and low temperature operability. These additives impart shear stability at elevated temperatures and acceptable viscosity at low temperatures. Suitable viscosity modifier may include polyolefins, olefin copolymers, ethylene/propylene copolymers, polyisobutenes, hydrogenated styrene-isoprene polymers, styrene/maleic ester copolymers, hydrogenated styrene/ butadiene copolymers, hydrogenated isoprene polymers, alpha-olefin maleic anhydride copolymers, polymethacrylates, polyacrylates, polyalkyl styrenes, and hydrogenated alkenyl aryl conjugated diene copolymers. Such additives can be present at 0.1 to 15 wt. % of the lubricating oil composition.

Pour Point Depressants

Pour point depressants lower the minimum temperature at which a fluid will flow or can be poured. Examples of suitable pour point depressants include polymethacrylates, polyacrylates, polyacrylamides, condensation products of haloparaffin waxes and aromatic compounds, vinyl carboxylate polymers, and terpolymers of dialkylfumarates, vinyl esters of fatty acids and allyl vinyl ethers. Such additives can be present at 0.01 to 1 wt. % of the lubricating oil composition.

Non-Ionic Surfactants

Non-ionic surfactants such as alkylphenol may improve asphaltene handling during engine operation. Examples of such materials include alkylphenol having an alkyl substituent from a straight chain or branched alkyl group having from 9 to 30 carbon atoms. Other examples include alkyl benzenol, alkylnaphthol and alkyl phenol aldehyde condensates where the aldehyde is formaldehyde such that the condensate is a methylene-bridged alkylphenol. Such additives can be present at 0.1 to 20 wt. % of the lubricating oil composition.

Thickeners

Thickeners such as polyisobutylene (PIB) and polyisobutenyl succinic anhydride (PIBSA) can be used to thicken lubricants. PIB and PIBSA are commercially available materials from several manufacturers. The PIB can be used in the manufacture of PIBSA and is typically a viscous oil-miscible liquid, having a weight average molecular weight in the range of 1000 to 8000 Daltons (e.g., 1500 to 6000 Daltons) and a kinematic viscosity at 100° C. in a range of 2000 to 6000 $mm^2/s$. Such additives can be present at 1 to 20 wt. % of the lubricating oil composition.

Use of the Lubricating Oil Composition

The lubricant compositions may be effective as engine oil or crankcase lubricating oils for spark-ignited and compression-ignited internal combustion engines, including automobile and truck engines, two-stroke cycle engines, aviation piston engines, marine diesel engines, stationary gas engines, and the like.

The internal combustion engine may be a 2-stroke or 4-stroke engine.

In an embodiment, the internal combustion engine is a marine diesel engine. The marine diesel engine may be a medium-speed 4-stroke compression-ignited engine having a speed of 250 to 1100 rpm or a low-speed crosshead 2-stroke compression-ignited engine having a speed of 200 rpm or less (e.g., 10 to 200 rpm, or 60 to 200 rpm).

The marine diesel engine may be lubricated with a marine diesel cylinder lubricant (typically in a 2-stroke engine), a system oil (typically in a 2-stroke engine), or a crankcase lubricant (typically a 4-stroke engine).

The term "marine" does not restrict the engines to those used in water-borne vessels; as is understood in the art, it also includes those for other industrial applications such as auxiliary power generation for main propulsion and stationary land-based engines for power generation.

In some embodiments, the internal combustion engine may be fueled with a residual fuel, a marine residual fuel, a low sulfur marine residual fuel, a marine distillate fuel, a low sulfur marine distillate fuel, or a high sulfur fuel.

A "residual fuel" refers to a material combustible in large marine engines which has a carbon residue, as determined by ISO 10370:2014, of at least 2.5 wt. % (e.g., at least 5 wt. %, or at least 8 wt. %), a viscosity at 50° C. of greater than 14.0 $mm^2/s$, such as the marine residual fuels defined in ISO 8217:2017 ("Petroleum products—Fuels (class F)—Specifications of marine fuels"). Residual fuels are primarily the non-boiling fractions of crude oil distillation. Depending on the pressures and temperatures in refinery distillation processes, and the types of crude oils, slightly more or less gas oil that could be boiled off is left in the non-boiling fraction, creating different grades of residual fuels.

A "marine residual fuel" is a fuel meeting the specification of a marine residual fuel as set forth in ISO 8217:2017. A "low sulfur marine residual fuel" is a fuel meeting the specification of a marine residual fuel as set forth in ISO 8217:2017 that, in addition, has 1.5 wt. % or less, or even 0.5 wt. % or less, of sulfur, relative to the total weight of the fuel, wherein the fuel is a residual product of a distillation process.

Distillate fuel is composed of petroleum fractions of crude oil that are separated in a refinery by a boiling or "distillation" process. A "marine distillate fuel" is a fuel meeting the specification of a marine distillate fuel as set forth in ISO 8217:2017. A "low sulfur marine distillate fuel" is a fuel meeting the specification of a marine distillate fuel as set forth in ISO 8217:2017 that, in addition, has about 0.1 wt. % of less, 0.05 wt. % or less, or even 0.005 wt. % or less of sulfur, relative to the total weight of the fuel, wherein the fuel is a distillation cut of a distillation process.

A "high sulfur fuel" is a fuel having greater than 1.5 wt. % of sulfur, relative to the total weight of the fuel.

The internal combustion engine can also be operable with a "gaseous fuel" such as a methane-dominated fuel (e.g., natural gas), a biogas, a gasified liquefied gas, or a gasified liquefied natural gas (LNG).

EXAMPLES

The following illustrative examples are intended to be non-limiting.

Test Methods

The Black Sludge Deposit (BSD) test is used to evaluate the ability of lubricants to cope with instable—unburned asphaltenes in residual fuel oil. The test measures the tendency of lubricants to cause deposits on a test strip, by applying oxidative thermal strain on a mixture of heavy fuel oil and lubricant. A sample of a lubricating oil composition is mixed with a specific amount of residual fuel to form test mixtures. The test mixture is pumped during the test as a thin film over a metal test strip, which is controlled at test temperature (200° C.) for a period of time (12 hours). The test oil-fuel mixture is recycled into the sample vessel. After the test, the test strip is cooled and then washed and dried. The test plates are then weighed. In this manner, the weight of the deposit remaining on the test plates was measured and recorded as the change in weight of the test plate. Better sludge handling is evidenced by lower weight of deposits remaining on the test plates.

Deposit control is measured by the Komatsu Hot Tube (KHT) test, which employs heated glass tubes through which sample lubricant is pumped, approximately 5 mL total sample, typically at 0.31 mL/hour for an extended period of time, such as 16 hours, with an air flow of 10 mL/minute. The glass tube is rated at the end of test for deposits on a scale of 1.0 (very heavy varnish) to 10 (no varnish). Test results are reported in multiples of 0.5. In the case the glass tubes are completely blocked with deposits, the test result is recorded as "blocked". Blockage is deposition below a 1.0 result, in which case the lacquer is very thick and dark but still allows fluid flow. The test is run at 310° C. and is described in SAE Technical Paper 840262.

Modified Institute of Petroleum Test Method 48 (MIP-48) is used to evaluate the oxidative stability of lubricants. In this test, two samples of lubricant are heated for a period of time. Nitrogen is passed through one of the test samples while air is passed through the other sample. The two samples are then cooled, and the viscosities of each sample determined. The oxidation-based viscosity increase for each lubricating oil composition is calculated by subtracting the kinematic viscosity at 100° C. for the nitrogen-blown sample from the kinematic viscosity at 100° C. for the air-blown sample, and dividing the subtraction product by the kinematic viscosity at 100° C. for the nitrogen blown sample. Better stability against oxidation-based viscosity increase is evidenced by lower viscosity increase.

Examples 1-5

A series of 40 BN trunk piston engine oil lubricants formulated with Group I base oil were prepared containing an ashless alkyl-substituted hydroxyaromatic carboxylic acid as well as conventional additives including an overbased calcium alkylhydroxybenzoate detergent ("Ca Detergent"), a zinc dialkyldithiophosphate (ZDDP), and a foam inhibitor. A comparative lubricant was prepared without the ashless alkyl-substituted hydroxyaromatic carboxylic acid. The lubricants were evaluated for sludge handling, deposit control, and oxidation-based viscosity increase and base number (BN) depletion.

The overbased calcium alkylhydroxybenzoate detergent has an alkyl substituent derived from $C_{20}$ to $C_{28}$ linear normal alpha-olefins and was prepared according to the method described in Example 1 of U.S. Patent Application Pub. No. 2007/0027043. As received, this additive contained 12.5 wt. % Ca and about 33 wt. % diluent oil and had a TBN of about 350 mg KOH/g and a basicity index of about 7.2. On an actives basis, the TBN of this additive is about 520 mg KOH/g.

The ashless alkyl-substituted hydroxyaromatic carboxylic acid is an oil concentrate of a $C_{20}$-$C_{24}$ hydrocarbyl substituted hydroxyaromatic salicylic acid derived from $C_{20}$-$C_{24}$ isomerized normal alpha-olefins. The concentrate contained about 25.0 wt. % diluent oil.

The results are summarized in Table 2. Weight percentages reported for the additives in Table 2 are on an as-received basis.

TABLE 2

| | Comp. Ex. A | Ex. 1 | Ex. 2 | Ex. 3 | Ex. 4 | Ex. 5 |
|---|---|---|---|---|---|---|
| Components | | | | | | |
| Ca Detergent, wt. % | 11.43 | 11.43 | 11.43 | 11.43 | 11.43 | 11.43 |
| Hydroxpromatic Carboxylic Acid, wt. % | — | 1.00 | 2.00 | 3.00 | 4.00 | 5.00 |
| ZDDP, wt. % | 0.70 | 0.70 | 0.70 | 0.70 | 0.70 | 0.70 |
| Foam Inhibitor, wt. % | 0.04 | 0.04 | 0.04 | 0.04 | 0.04 | 0.04 |
| 600N Group I Base Oil, wt. % | 77.20 | 76.05 | 74.90 | 73.75 | 72.66 | 71.55 |
| Bright Stock, wt. % | 10.63 | 10.78 | 10.93 | 11.08 | 11.17 | 11.28 |
| Lubricant Properties | | | | | | |
| SAE Viscosity Grade | 40 | 40 | 40 | 40 | 40 | 40 |
| TBN, mg KOH/g | 39.9 | 40.0 | 39.2 | 39.4 | 40.2 | 40.1 |
| $KV_{100}$, $mm^2/s$ | 14.5 | 14.5 | 14.5 | 14.6 | 14.6 | 14.7 |
| Ca, wt. % | 1.47 | 1.58 | 1.49 | 1.50 | 1.47 | 1.47 |
| P, ppm | 484 | 520 | 487 | 492 | 484 | 483 |
| Zn, ppm | 550 | 590 | 555 | 561 | 553 | 549 |
| Test Results | | | | | | |
| BSD (10% HFO, 200° C.) deposits, mg | 29.7 | 25.4 | 9.9 | 1.6 | 3.0 | 3.0 |
| KHT (310° C.), rating | 5.5 | 6.0 | 6.0 | 6.0 | 7.0 | 8.0 |
| Modified IP-48 Viscosity Increase, % | 50.8 | 37.2 | 28.5 | 27.1 | 27.2 | 26.1 |
| Modified IP-48 BN Depletion, % | 19.7 | 16.9 | 18.0 | 16.7 | 13.2 | 12.7 |

As is evident from the results illustrated in Table 2, the trunk piston engine lubricating oil compositions containing an ashless alkyl-substituted hydroxyaromatic carboxylic acid (Examples 1-5) exhibited surprisingly less black sludge formation in marine residual fuels, improved deposit control, and improved stability against oxidation-based viscosity increase and BN depletion than the lubricating oil composition without the ashless alkyl-substituted hydroxyaromatic carboxylic acid (Comparative Example A).

Examples 6-10

A series of 40 BN trunk piston engine oil lubricants formulated with Group II base oil were prepared containing an ashless alkyl-substituted hydroxyaromatic carboxylic acid as well as conventional additives including an overbased calcium alkylhydroxybenzoate detergent a zinc dialkyldithiophosphate (ZDDP), and a foam inhibitor as described in Examples 1-5. A comparative lubricant was prepared without the ashless alkyl-substituted hydroxyaromatic carboxylic acid. The lubricants were evaluated for sludge handling, deposit control, and oxidation-based viscosity increase and BN depletion. The results are summarized in Table 3. Weight percentages reported for the additives in Table 3 are on an as-received basis.

TABLE 3

| | Comp. Ex. B | Ex. 6 | Ex. 7 | Ex. 8 | Ex. 9 | Ex. 10 |
|---|---|---|---|---|---|---|
| Components | | | | | | |
| Ca Detergent, wt. % | 11.43 | 11.43 | 11.43 | 11.43 | 11.43 | 11.43 |
| Hydroxyaromatic Carboxylic Acid, wt. % | — | 1.00 | 2.00 | 3.00 | 4.00 | 5.00 |
| ZDDP, wt. % | 0.70 | 0.70 | 0.70 | 0.70 | 0.70 | 0.70 |
| Foam Inhibitor, wt. % | 0.04 | 0.04 | 0.04 | 0.04 | 0.04 | 0.04 |
| 600R Group II Base Oil, wt. % | 74.00 | 72.85 | 71.70 | 70.55 | 69.40 | 68.25 |
| Bright Stock, wt. % | 13.83 | 13.98 | 14.13 | 14.28 | 14.43 | 14.58 |
| Lubricant Properties | | | | | | |
| SAE Viscosity Grade | 40 | 40 | 40 | 40 | 40 | 40 |
| TBN, mg KOH/g | 40.2 | 40.9 | 39.6 | 39.8 | 39.7 | 39.4 |
| $KV_{100}$, $mm^2/s$ | 14.5 | 14.5 | 14.5 | 14.6 | 14.7 | 14.7 |
| Ca, wt. % | 1.47 | 1.50 | 1.47 | 1.54 | 1.49 | 1.53 |
| P, ppm | 481 | 491 | 483 | 507 | 490 | 508 |
| Zn, ppm | 545 | 555 | 551 | 581 | 558 | 569 |
| Test Results | | | | | | |
| BSD (10% HFO, 200° C.) deposits, mg | 108.6 | 73.1 | 48.1 | 20.6 | 13.0 | 29.3 |
| KHT (310° C.), rating | 4.0 | 4.5 | 4.5 | 4.5 | 6.0 | 6.5 |
| Modified IP-48 Visc. Increase, % | 45.9 | 43.0 | 24.9 | 7.0 | 8.3 | 10.1 |
| Modified IP-48 BN Depletion, % | 14.3 | 12.1 | 8.8 | 6.6 | 8.1 | 8.7 |

As is evident from the results illustrated in Table 3, the trunk piston engine lubricating oil compositions containing the ashless alkyl-substituted hydroxyaromatic carboxylic acid (Examples 6-10) exhibited a surprisingly less black sludge formation in marine residual fuels, improved deposit control, and improved stability against oxidation-based viscosity increase and BN depletion than the lubricating oil composition without the ashless alkyl-substituted hydroxyaromatic carboxylic acid (Comparative Example B).

Example 11

A series of 140 BN marine cylinder lubricants formulated with Group I base oil were prepared containing an ashless alkyl-substituted hydroxyaromatic carboxylic acid as well as conventional additives including an overbased calcium-sulfonate detergent, an overbased sulfurized calcium phenate detergent, a bissuccinimide dispersant and a foam inhibitor. A comparative lubricant was prepared without the ashless alkyl-substituted hydroxyaromatic carboxylic acid. The lubricants were evaluated for sludge handling, deposit control, and oxidation-based viscosity increase and base number (BN) depletion.

The ashless alkyl-substituted hydroxyaromatic carboxylic acid is an oil concentrate of a C20-C24 hydrocarbyl substituted hydroxyaromatic salicylic acid derived from C20-C24 isomerized normal alpha-olefins. The additive contained about 25.0 wt. % diluent oil.

The results are summarized in Table 4. Weight percentages reported for the additives in Table 4 are on an as-received basis.

TABLE 4

| | Comp. Ex. C | Ex. 11 |
|---|---|---|
| Components | | |
| Ca Sulfonate Detergent, wt. % | 21.96 | 21.96 |
| Ca Phenate Detergent, wt. % | 18.25 | 18.26 |

TABLE 4-continued

| | Comp. Ex. C | Ex. 11 |
|---|---|---|
| Bissuccinimide Dispersant, wt. % | 0.32 | 0.31 |
| Foam Inhibitor, wt. % | 0.22 | 0.22 |
| Hydroxyaromatic Carboxylic Acid, wt. % | 0.00 | 5.00 |
| 150N Group I Base Oil, wt. % | 6.89 | 7.43 |
| 600N Group I Base Oil, wt. % | 52.36 | 46.83 |
| Lubricant Properties | | |
| SAE Viscosity Grade | 50 | 50 |
| TBN, mg KOH/g | 139.00 | 144.00 |
| $KV_{100}$, $mm^2/s$ | 18.6 | 18.8 |
| Test Results | | |
| BSD (10% HFO, 200° C.) deposits, mg | 92.8 | 72.1 |

As is evident from the results illustrated in Table 4, the marine cylinder lubricant containing an ashless alkyl-substituted hydroxyaromatic carboxylic acid (Example 11) exhibited a surprisingly less black sludge formation in marine residual fuels than the lubricating oil composition without the ashless alkyl-substituted hydroxyaromatic carboxylic acid (Comparative Example C).

Example 12

A series of 12 BN trunk piston engine oil lubricants formulated with Group I base oil were prepared containing an ashless alkyl-substituted hydroxyaromatic carboxylic acid as well as conventional additives including an overbased calcium alkylhydroxybenzoate detergent ("Ca Detergent"), a zinc dialkyldithiophosphate (ZDDP), and a foam inhibitor as described in Examples 1-5. A comparative lubricant was prepared without the ashless alkyl-substituted hydroxyaromatic carboxylic acid. The lubricants were evaluated for sludge handling, deposit control, and oxidation-based viscosity increase and base number (BN) depletion.

The overbased calcium alkylhydroxybenzoate detergent has an alkyl substituent derived from C20 to C28 linear normal alpha-olefins and was prepared according to the method described in Example 1 of U.S. Patent Application Pub. No. 2007/0027043. As received, this additive contained 12.5 wt. % Ca and about 33 wt. % diluent oil and had a TBN of about 350 mg KOH/g and a basicity index of about 7.2. On an actives basis, the TBN of this additive is about 520 mg KOH/g.

The ashless alkyl-substituted hydroxyaromatic carboxylic acid is an oil concentrate of a C20-C24 hydrocarbyl substituted hydroxyaromatic salicylic acid derived from C20-C24 isomerized normal alpha-olefins. This additive contained about 25.0 wt. % diluent oil.

The results are summarized in Table 5. Weight percentages reported for the additives in Table 5 are on an as-received basis.

TABLE 5

| | Comp. Ex. D | Ex. 12 |
|---|---|---|
| Components | | |
| Ca Detergent, wt. % | 3.43 | 3.43 |
| Hydroxyaromatic Carboxylic Acid, wt. % | 0.00 | 5.00 |
| ZDDP, wt. % | 0.70 | 0.70 |
| Foam Inhibitor, wt. % | 0.04 | 0.04 |
| 600N Group I Base Oil, wt. % | 77.80 | 73.38 |
| Bright Stock, wt. % | 18.03 | 17.45 |
| Lubricant Properties | | |
| SAE Viscosity Grade | 40 | 40 |
| TBN, mg KOH/g | 12.5 | 12.3 |
| $KV_{100}$, $mm^2/s$ | 14.51 | 14.52 |
| Ca, wt. % | 0.46 | 0.45 |
| P, ppm | 532 | 514 |
| Zn, ppm | 594 | 572 |
| Test Results | | |
| BSD (10% HFO, 200° C.) deposits, mg | 1094.4 | 140.2 |
| KHT (310° C.), rating | 4.0 | 7.0 |
| Modified IP-48 Viscosity Increase, % | 43.2 | 34.2 |
| Modified IP-48 BN Depletion, % | 44.9 | 35.9 |

As is evident from the results illustrated in Table 5, the trunk piston engine lubricating oil compositions containing the ashless alkyl-substituted hydroxyaromatic carboxylic acid (Examples 12) exhibited a surprisingly less black sludge formation in marine residual fuels, improved deposit control, and improved stability against oxidation-based viscosity increase and BN depletion than the lubricating oil composition without the ashless alkyl-substituted hydroxyaromatic carboxylic acid (Comparative Example D).

Example 13

A series of 50 BN trunk piston engine oil lubricants formulated with Group I base oil were prepared containing an ashless alkyl-substituted hydroxyaromatic carboxylic acid as well as conventional additives including an overbased calcium alkylhydroxybenzoate detergent ("Ca Detergent"), a zinc dialkyldithiophosphate (ZDDP), and a foam inhibitor as described in Examples 1-5. A comparative lubricant was prepared without the ashless alkyl-substituted hydroxyaromatic carboxylic acid. The lubricants were evaluated for sludge handling, deposit control, and oxidation-based viscosity increase and base number (BN) depletion.

The overbased calcium alkylhydroxybenzoate detergent has an alkyl substituent derived from C20 to C28 linear normal alpha-olefins and was prepared according to the method described in Example 1 of U.S. Patent Application Pub. No. 2007/0027043. As received, this additive contained 12.5 wt. % Ca and about 33 wt. % diluent oil and had a TBN of about 350 mg KOH/g and a basicity index of about 7.2. On an actives basis, the TBN of this additive is about 520 mg KOH/g.

The ashless alkyl-substituted hydroxyaromatic carboxylic acid is an oil concentrate of a C20-C24 hydrocarbyl substituted hydroxyaromatic salicylic acid derived from C20-C24 isomerized normal alpha-olefins. This additive contained about 25.0 wt. % diluent oil.

The results are summarized in Table 6. Weight percentages reported for the additives in Table 6 are on an as-received basis.

TABLE 6

| | Comp. Ex. E | Ex. 13 |
|---|---|---|
| Components | | |
| Ca Detergent, wt. % | 3.43 | 3.43 |
| Hydroxyaromatic Carboxylic Acid, wt. % | 0.00 | 5.00 |
| ZDDP, wt. % | 0.70 | 0.70 |
| Foam Inhibitor, wt. % | 0.04 | 0.04 |
| 600N Group I Base Oil, wt. % | 74.88 | 70.30 |
| Bright Stock, wt. % | 10.09 | 9.67 |
| Lubricant Properties | | |
| SAE Viscosity Grade | 40 | 40 |
| TBN, mg KOH/g | 49.2 | 50.0 |
| $KV_{100}$, $mm^2/s$ | 14.58 | 14.57 |
| Ca, wt. % | 1.87 | 1.86 |
| P, ppm | 502 | 499 |
| Zn, ppm | 566 | 569 |
| Test Results | | |
| BSD (10% HFO, 200° C.) deposits, mg | 9.6 | 3.3 |
| KHT (310° C.), rating | 5.0 | 8.0 |
| Modified IP-48 Viscosity Increase, % | 34.8 | 33.6 |
| Modified IP-48 BN Depletion, % | 15.4 | 11.2 |

As is evident from the results illustrated in Table 6, the trunk piston engine lubricating oil compositions containing the ashless alkyl-substituted hydroxyaromatic carboxylic acid (Examples 13) exhibited a surprisingly less black sludge formation in marine residual fuels, improved deposit control, and improved stability against oxidation-based viscosity increase and BN depletion than the lubricating oil composition without the ashless alkyl-substituted hydroxyaromatic carboxylic acid (Comparative Example E).

Examples 14-17

A series of 40 BN trunk piston engine oil lubricants formulated with Group I base oil were prepared containing an ashless alkyl-substituted hydroxyaromatic carboxylic acid as well as conventional additives including an overbased calcium alkylhydroxybenzoate detergent ("Ca Detergent"), a zinc dialkyldithiophosphate (ZDDP), and a foam inhibitor as described in Examples 1-5. A comparative lubricant was prepared without the ashless alkyl-substituted hydroxyaromatic carboxylic acid. The lubricants were evaluated for sludge handling, deposit control, and oxidation-based viscosity increase and base number (BN) depletion.

The overbased calcium alkylhydroxybenzoate detergent has an alkyl substituent derived from C20 to C28 linear normal alpha-olefins and was prepared according to the method described in Example 1 of U.S. Patent Application Pub. No. 2007/0027043. As received, this additive contained 12.5 wt. % Ca and about 33 wt. % diluent oil and had a TBN of about 350 mg KOH/g and a basicity index of about 7.2. On an actives basis, the TBN of this additive is about 520 mg KOH/g.

The ashless alkyl-substituted hydroxyaromatic carboxylic acid is an oil concentrate of a C20-C24 hydrocarbyl substituted hydroxyaromatic salicylic acid derived from C20-C24 isomerized normal alpha-olefins (containing 25.0 wt. % diluent oil), a C20-C28 hydrocarbyl substituted hydroxyaromatic salicylic acid derived from C20-C28 normal alpha-olefins (containing 25.0 wt. % diluent oil), a C14-C16-C18 hydrocarbyl substituted hydroxyaromatic salicylic acid derived from C14-C16-C18 normal alpha-olefins (containing about 20.0 wt. % diluent oil), or a C20-C24 hydrocarbyl substituted naphthoic acid derived from C20-C24 isomerized normal alpha-olefins (containing about 20.0 wt. % diluent oil).

The results are summarized in Table 7. Weight percentages reported for the additives in Table 7 are on an as-received basis.

TABLE 7

| | Ex. 14 | Ex. 15 | Ex. 16 | Ex. 17 |
|---|---|---|---|---|
| Components | | | | |
| Ca Detergent, wt. % | 11.43 | 11.43 | 11.43 | 11.43 |
| C20-C24 Hydroxyaromatic Carboxylic Acid, wt. % | 5.00 | — | — | — |
| C20-C28 Hydroxyaromatic Carboxylic Acid, wt. % | | 5.00 | — | — |
| C14-C16-C18 Hydroxyaromatic Carboxylic Acid, wt. % | | — | 5.00 | — |
| C20-C24 Naphthoic Acid, wt. % | | — | — | 5.00 |
| ZDDP, wt. % | 0.70 | 0.70 | 0.70 | 0.70 |
| Foam Inhibitor, wt. % | 0.04 | 0.04 | 0.04 | 0.04 |
| 600N Group I Base Oil, wt. % | 72.70 | 74.02 | 71.88 | 69.51 |
| Bright Stock, wt. % | 10.13 | 8.81 | 10.95 | 13.32 |
| Lubricant Properties | | | | |
| SAE Viscosity Grade | 40 | 40 | 40 | 40 |
| TBN, mg KOH/g | 39.9 | 40.1 | 40.3 | 40.3 |
| $KV_{100}$, $mm^2/s$ | 14.36 | 14.37 | 14.51 | 14.42 |
| Ca, wt. % | 1.50 | 1.49 | 1.48 | 1.50 |
| P, ppm | 510 | 545 | 536 | 508 |
| Zn, ppm | 573 | 614 | 602 | 573 |
| Test Results | | | | |
| BSD (10% HFO, 200° C.) deposits, mg | 1.7 | 1.8 | −3.7 | 4.2 |
| KHT (310° C.), rating | 8.0 | 7.0 | 7.0 | 6.5 |
| Modified IP-48 Viscosity Increase, % | 28.9 | 30.9 | 33.6 | 28.5 |
| Modified IP-48 BN Depletion, % | 13.1 | 16.0 | 14.9 | 16.2 |

As is evident from the results illustrated in Table 7, the trunk piston engine lubricating oil compositions containing an ashless alkyl-substituted hydroxyaromatic carboxylic acid (Examples 14-17) exhibited surprisingly less black sludge formation in marine residual fuels, improved deposit control, and improved stability against oxidation-based viscosity increase and BN depletion than the lubricating oil composition without the ashless alkyl-substituted hydroxyaromatic carboxylic acid (Comparative Example A).

Example 18

A series of 7 BN system oils formulated with Group I base oil were prepared containing an ashless alkyl-substituted hydroxyaromatic carboxylic acid as well as conventional additives including a zinc dialkyldithiophosphate (ZDDP), and a foam inhibitor. These samples also included two types of calcium detergents, an overbased calcium sulfonate detergent and an overbased sulfurized calcium phenate detergent, and bisuccinimide dispersant. A comparative lubricant was prepared without the ashless alkyl-substituted hydroxyaromatic carboxylic acid. The lubricants were evaluated for sludge handling, deposit control, and oxidation-based viscosity increase and base number (BN) depletion.

The ashless alkyl-substituted hydroxyaromatic carboxylic acid is an oil concentrate of a C20-C24 hydrocarbyl substituted hydroxyaromatic salicylic acid derived from C20-C24 isomerized normal alpha-olefins. This additive contained about 25.0 wt. % diluent oil.

The results are summarized in Table 8. Weight percentages reported for the additives in Table 8 are on an as-received basis.

TABLE 8

| | Comp. Ex. F | Ex. 18 |
|---|---|---|
| Components | | |
| Ca Sulfonate Detergent, wt. % | 0.96 | 0.96 |
| Ca Phenate Detergent, wt. % | 0.80 | 0.80 |
| ZDDP, wt. % | 0.70 | 0.70 |
| Bissuccinimide Dispersant, wt. % | 0.51 | 0.51 |
| Foam Inhibitor, wt. % | 0.01 | 0.01 |
| Hydroxyaromatic Carboxylic Acid, wt. % | 0.00 | 5.00 |
| 150N Group I Base Oil, wt. % | 9.34 | 10.10 |
| 600N Group I Base Oil, wt. % | 87.69 | 81.93 |
| Lubricant Properties | | |
| SAE Viscosity Grade | 30 | 30 |
| TBN, mg KOH/g | 6.7 | 6.8 |
| $KV_{100}$, $mm^2/s$ | 11.52 | 11.54 |
| Ca, wt. % | IP | IP |
| P, ppm | IP | IP |
| Zn, ppm | IP | IP |
| Test Results | | |
| BSD (1.0% HFO, 200° C.) deposits, mg | 139.7 | 3.9 |
| KHT (280° C.), rating | 2.5 | 6.5 |
| Modified IP-48 Viscosity Increase, % | 91.8 | 56.3 |
| Modified IP-48 BN Depletion, % | 92.6 | 81.2 |

As is evident from the results illustrated in Table 8, the system oil containing an ashless alkyl-substituted hydroxyaromatic carboxylic acid (Example 18) exhibited surprisingly less black sludge formation in marine residual fuels, improved deposit control, and improved stability against oxidation-based viscosity increase and BN depletion than the lubricating oil composition without the ashless alkyl-substituted hydroxyaromatic carboxylic acid (Comparative Example F).

The invention claimed is:

1. A lubricating oil composition comprising (a) greater than 50 wt. % of a base oil of lubricating viscosity; and (b) 0.1 to 20 wt. % of an ashless alkyl-substituted hydroxyaromatic carboxylic acid, wherein the alkyl substituent of the ashless alkyl-substituted hydroxyaromatic carboxylic acid has from 12 to 40 carbon atoms; wherein the lubricating oil composition is a monograde lubricating oil composition meeting specifications for SAE BOO revised January 2015 requirements for a SAE 20, 30, 40, 50, or 60 monograde engine oil, and has a TBN of 5 to 200 mg KOH/g, as determined by ASTM D2896.

2. The lubricating oil composition of claim 1, wherein the alkyl substituent of the ashless alkyl-substituted hydroxyaromatic carboxylic acid is a residue derived from an alpha-olefin having from 14 to 28 carbon atoms per molecule.

3. The lubricating oil composition of claim 1, wherein the alkyl substituent of the ashless alkyl-substituted hydroxyaromatic carboxylic acid is a residue derived from an alpha-olefin having from 20 to 24 carbon atoms per molecule.

4. The lubricating oil composition of claim 1, wherein the alkyl substituent of the ashless alkyl-substituted hydroxyaromatic carboxylic acid is a residue derived from an alpha-olefin having from 20 to 28 carbon atoms per molecule.

5. A lubricating oil composition as in any one of claims 2, 3, and 4, in which the alpha-olefin is a normal alpha-olefin, an isomerized normal alpha-olefin, or a mixture thereof.

6. The lubricating oil composition of claim 1, wherein an amount of the ashless alkyl-substituted hydroxybenzoic acid is in a range of 1.0 to 5.0 wt. % of the lubricating oil composition.

7. The lubricating oil composition of claim 1, wherein the lubricating oil composition has a TBN in one of the following ranges: 5 to 10 mg KOH/g, 15 to 150 mg KOH/g, 20 to 80 mg KOH/g, 30 to 100 mg KOH/g, 30 to 80 mg KOH/g, 60 to 100 mg KOH/g, 60 to 150 mg KOH/g.

8. The lubricating oil composition of claim 1, further comprising one or more of a metal detergent, a dispersant, an antiwear agent, an antioxidant, a friction modifier, a corrosion inhibitor, a rust inhibitor, a demulsifier, a foam inhibitor, a viscosity modifier, a pour point depressant, a non-ionic surfactant, and a thickener.

9. A method of lubricating an internal combustion engine comprising supplying to the internal combustion engine the lubricating oil composition of claim 1.

10. The method of claim 9, wherein the internal combustion engine is a compression-ignited engine.

11. The method of claim 10, wherein the compression-ignited engine is a 4-stroke engine operated at 250 to 1100 rpm.

12. The method of claim 10, wherein the compression ignited engine is a 2-stroke engine operated at 200 rpm or less.

13. The method of claim 10, wherein the compression-ignited engine is fueled with a residual fuel, a marine residual fuel, a low sulfur marine residual fuel, a marine distillate fuel, a low sulfur marine distillate fuel, a high sulfur fuel, or a gaseous fuel.

14. The lubricating oil composition of claim 1, wherein an amount of the ashless alkyl-substituted hydroxyaromatic carboxylic acid is in a range of 1.0 to 5.0 wt. % of the lubricating oil composition and wherein the alkyl substituent of the ashless alkyl-substituted hydroxyaromatic carboxylic acid is a residue derived from an alpha-olefin having from 20 to 28 carbon atoms per molecule.

* * * * *